US009117615B2

(12) United States Patent
Salonga et al.

(10) Patent No.: US 9,117,615 B2
(45) Date of Patent: Aug. 25, 2015

(54) DOUBLE WOUND FUSIBLE ELEMENT AND ASSOCIATED FUSE

(75) Inventors: Bienvenido Salonga, Batangas (PH); Francisco De Guia, Laguna (PH); Alvin Salvador, Cubuyano Laguna (PH)

(73) Assignee: LITTLEFUSE, INC., Chicago, IL (US)

( * ) Notice: Subject to any disclaimer, the term of this patent is extended or adjusted under 35 U.S.C. 154(b) by 380 days.

(21) Appl. No.: 13/107,527

(22) Filed: May 13, 2011

(65) Prior Publication Data

US 2011/0279218 A1 Nov. 17, 2011

Related U.S. Application Data

(60) Provisional application No. 61/345,322, filed on May 17, 2010.

(51) Int. Cl.

| | |
|---|---|
| ***H01H 85/46*** | (2006.01) |
| ***H01H 85/04*** | (2006.01) |
| ***H01H 85/08*** | (2006.01) |
| ***H01H 85/055*** | (2006.01) |
| ***H01H 85/12*** | (2006.01) |
| ***H01H 85/18*** | (2006.01) |

(52) U.S. Cl.

CPC ..... *H01H 85/08* (2013.01); *H01H 85/055* (2013.01); *H01H 85/12* (2013.01); *H01H 85/185* (2013.01)

(58) Field of Classification Search

CPC ... H01H 85/185; H01H 85/08; H01H 85/055; H01H 85/12

USPC ..... 337/187, 290, 159, 161, 297, 198

See application file for complete search history.

(56) References Cited

U.S. PATENT DOCUMENTS

| | | | | |
|---|---|---|---|---|
| 441,933 | A | 12/1890 | Cartwright | |
| 480,802 | A | 8/1892 | Blathy | |
| 876,273 | A | 1/1908 | Hall | |
| 1,120,226 | A | 12/1914 | Murray, Jr. | |
| 1,121,876 | A | 12/1914 | Schipper | |
| 1,377,398 | A | 5/1921 | Conrad | |
| 1,443,886 | A | 1/1923 | Sands | |
| 1,485,211 | A | 2/1924 | Berger | |
| 1,502,881 | A | 7/1924 | Sandin | |
| 1,542,608 | A | 6/1925 | Bussmann | |
| 1,545,550 | A * | 7/1925 | Coates | 337/231 |

(Continued)

FOREIGN PATENT DOCUMENTS

| | | |
|---|---|---|
| DE | 450343 | 10/1927 |
| DE | 721967 | 6/1942 |

(Continued)

OTHER PUBLICATIONS

Office Action issued Oct. 20, 2014 in corresponding JP2011-110243.

*Primary Examiner* — Anatoly Vortman

(74) *Attorney, Agent, or Firm* — Kacvinsky Daisak Bluni PLLC

(57) ABSTRACT

An improved fusible element for use within a circuit protection device is provided which includes a double wound fusible element configured to withstand high surge current associated with inductive and capacitive loads. The fusible element includes an insulated core having a longitudinal axis, a first wire wound about the core along the longitudinal axis of the core, and a second wire wound substantially orthogonally about a longitudinal axis of the first wire such that the fusible element is configured to withstand an over-current surge condition.

7 Claims, 4 Drawing Sheets

(56) References Cited

U.S. PATENT DOCUMENTS 1,562,985 A 11/1925 Murray
1,889,585 A 11/1932 Zodrow et al.
1,927,905 A * 9/1933 Slepian et al. ..... 337/159
1,954,037 A * 4/1934 Bowie ..... 337/224
2,168,153 A 8/1939 Brown
2,639,350 A 5/1953 Cox
2,662,952 A 12/1953 Nivoix
2,672,542 A 3/1954 Fisher
2,873,327 A 2/1959 Bernstein
2,876,312 A 3/1959 Frederick
2,929,900 A 3/1960 White
3,094,600 A 6/1963 Kozacka
3,143,615 A 8/1964 Kozacka
3,197,593 A 7/1965 Lange et al.
3,222,479 A * 12/1965 Franklin et al. ..... 337/159
3,267,238 A * 8/1966 Arikawa et al. ..... 337/164
3,267,240 A 8/1966 Fitzgerald
3,275,772 A 9/1966 Neff
3,301,979 A 1/1967 Fister
3,333,336 A 8/1967 Cameron
3,368,047 A * 2/1968 McClure, Jr. ..... 337/228
3,425,019 A 1/1969 Kozacka
3,460,086 A 8/1969 Fister
3,529,270 A 9/1970 Kozacka
3,601,737 A 8/1971 Baird
3,614,699 A 10/1971 Fister
3,701,979 A 10/1972 Belcher
3,721,936 A 3/1973 Belcher
3,766,509 A 10/1973 Cameron
3,825,870 A 7/1974 Ono et al.
3,868,619 A 2/1975 Blewitt
3,946,351 A 3/1976 Bronikowski et al.
3,962,668 A 6/1976 Knapp, Jr.
3,979,709 A 9/1976 Healey, Jr.
3,983,524 A 9/1976 Koch
3,983,526 A 9/1976 Koch
4,032,879 A 6/1977 Monagan
4,035,753 A 7/1977 Reeder
4,057,774 A * 11/1977 Arikawa et al. ..... 337/164
4,075,755 A 2/1978 Bernatt et al.
4,122,426 A 10/1978 Maruo
4,135,175 A 1/1979 Perreault
4,146,861 A 3/1979 Arikawa et al.
4,158,187 A 6/1979 Perreault
4,177,444 A 12/1979 Taki
4,189,696 A 2/1980 Beswick et al.
4,205,294 A 5/1980 Jacobs, Jr.
4,215,331 A 7/1980 Kozacka
4,227,228 A 10/1980 Cheng
4,228,417 A 10/1980 Belcher
4,237,440 A 12/1980 Miyasaka et al.
4,267,543 A 5/1981 Arikawa
4,276,531 A 6/1981 Davis
4,283,700 A 8/1981 Akiyama
4,297,666 A 10/1981 Adollahi
4,346,362 A 8/1982 Feenan et al.
4,373,556 A 2/1983 Bergh
4,386,334 A 5/1983 Kozacka et al.
4,409,729 A 10/1983 Shah
4,414,528 A 11/1983 Bernstein
4,417,224 A 11/1983 Ross
4,417,226 A 11/1983 Asdollahi et al.
4,445,106 A 4/1984 Shah
4,460,887 A 7/1984 McAlear et al.
4,467,308 A 8/1984 Arikawa et al.
4,489,301 A 12/1984 Johnson et al.
4,511,875 A 4/1985 Arikawa
4,517,544 A 5/1985 Spaunhorst
4,528,536 A 7/1985 Blewitt et al.
4,532,489 A 7/1985 Phillips
4,533,895 A 8/1985 Kowalik et al.
4,540,969 A 9/1985 Sugar
4,559,514 A 12/1985 Arikawa
4,560,971 A * 12/1985 Oh ..... 337/164
4,563,666 A 1/1986 Borzoni
4,563,809 A 1/1986 Reeder
4,608,548 A 8/1986 Borzoni
4,630,022 A 12/1986 Yuza
4,636,765 A 1/1987 Krueger
4,646,053 A 2/1987 Mosesian
4,656,453 A 4/1987 Reeder
4,680,567 A 7/1987 Edwards
4,684,915 A 8/1987 Knapp, Jr.
4,703,299 A 10/1987 Vermij
4,736,180 A 4/1988 Oh
4,746,784 A 5/1988 Vermij
4,749,980 A 6/1988 Morrill, Jr. et al.
4,751,489 A 6/1988 Spaumhorst
4,837,546 A 6/1989 Bernstein
4,851,805 A 7/1989 Poerschike
4,870,386 A * 9/1989 Arikawa ..... 337/162
RE33,137 E * 12/1989 Gurevich et al. ..... 337/255
4,890,380 A 1/1990 Narancic et al.
4,894,633 A 1/1990 Holtfreter
4,899,123 A * 2/1990 Asdollahi et al. ..... 337/273
4,918,420 A 4/1990 Sexton
4,920,327 A 4/1990 Arikawa et al.
4,965,925 A 10/1990 Monter
4,972,169 A 11/1990 Kalra
4,988,969 A * 1/1991 Gurevich ..... 337/260
4,996,509 A 2/1991 Bernstein
5,003,281 A * 3/1991 Reese ..... 337/252
5,101,187 A 3/1992 Yuza
5,109,211 A 4/1992 Huber
5,142,262 A 8/1992 Onken
5,153,553 A 10/1992 Ruehl et al.
5,162,773 A 11/1992 Shiozaki
5,179,436 A * 1/1993 Asdollahi et al. ..... 337/203
5,187,463 A 2/1993 DiTroia et al.
5,214,406 A 5/1993 Reese et al.
5,229,739 A 7/1993 Oh et al.
5,235,307 A 8/1993 Oh
5,245,308 A 9/1993 Herbias
5,247,274 A 9/1993 Gurevich
5,252,942 A 10/1993 Gurevich
5,254,967 A 10/1993 Biasutti et al.
5,280,261 A 1/1994 Mollet
5,298,877 A 3/1994 Gurevich
5,345,210 A 9/1994 Swensen et al.
5,355,110 A 10/1994 Ruggiero et al.
5,359,174 A 10/1994 Smith et al.
5,361,058 A 11/1994 Mosesian et al.
5,363,082 A 11/1994 Gurevich
5,406,245 A 4/1995 Smith et al.
5,446,436 A 8/1995 Williams
5,596,306 A 1/1997 Kowalik et al.
5,617,069 A 4/1997 Arikawa et al.
5,642,090 A 6/1997 Arikawa
5,661,628 A 8/1997 Yamagami
5,726,620 A 3/1998 Arikawa
5,736,919 A 4/1998 Reeder
5,739,740 A 4/1998 Stark et al.
5,781,095 A 7/1998 Dietsch et al.
5,783,985 A 7/1998 Kowalik et al.
5,812,046 A 9/1998 Brown et al.
5,841,337 A * 11/1998 Douglass ..... 337/198
5,898,358 A 4/1999 Tompkins et al.
5,903,208 A 5/1999 Sorger
5,927,060 A * 7/1999 Watson ..... 57/210
5,994,994 A 11/1999 Ito et al.
6,005,470 A 12/1999 Smith et al.
6,067,004 A 5/2000 Hibayashi et al.
6,147,585 A 11/2000 Kaira et al.
6,160,471 A 12/2000 Rybka et al.
6,191,678 B1 2/2001 Edwards
6,507,265 B1 1/2003 Ackerman
6,542,063 B2 * 4/2003 Kawashima et al. ..... 337/203
6,552,646 B1 4/2003 Wong
6,577,222 B1 6/2003 Krueger et al.
6,642,833 B2 11/2003 Ranjan et al.
6,650,223 B1 11/2003 Jollenbeck et al.
6,664,886 B2 12/2003 Ackermann
6,778,061 B2 * 8/2004 Nakano et al. ..... 337/248
6,798,330 B2 9/2004 Arikawa et al.

(56) References Cited

U.S. PATENT DOCUMENTS

| | | | | |
|---|---|---|---|---|
| 6,903,649 | B2 | 6/2005 | Ackermann | |
| 7,320,171 | B2 | 1/2008 | Jollenbeck et al. | |
| 7,439,844 | B2 | 10/2008 | Hase et al. | |
| 2002/0113684 | A1* | 8/2002 | Arikawa et al. | 337/163 |
| 2007/0132539 | A1 | 6/2007 | Richter et al. | |
| 2007/0236323 | A1 | 10/2007 | Schmidt et al. | |
| 2008/0084267 | A1* | 4/2008 | Jollenbeck et al. | 337/246 |
| 2010/0060406 | A1* | 3/2010 | Kim et al. | 337/187 |
| 2012/0068809 | A1* | 3/2012 | Spalding | 337/228 |

FOREIGN PATENT DOCUMENTS

| | | |
|---|---|---|
| DE | 3051177 | 3/1981 |
| DE | 8608325 | 9/1987 |
| DE | 3833329 A1 | 4/1989 |
| DE | 3833329 C2 | 4/1989 |
| DE | 9407540 | 10/1995 |
| DE | 29616063 | 12/1996 |
| DE | 29706366 | 7/1997 |
| EP | 0423897 | 4/1991 |
| FR | 2638566 | 5/1990 |
| GB | 396197 | 8/1933 |
| GB | 659689 | 10/1951 |
| GB | 811962 | 4/1959 |
| GB | 1200702 | 7/1970 |
| GB | 1200707 | 7/1970 |
| GB | 2233512 | 9/1991 |
| GB | 2248734 | 4/1992 |
| JP | 51117129 U | 9/1976 |
| JP | 5646168 U | 4/1981 |
| JP | 517903 | 1/1993 |
| JP | 572033 | 1/1993 |
| WO | 85/01149 | 3/1985 |
| WO | 96/08832 | 3/1996 |
| WO | 96/41359 | 12/1996 |

* cited by examiner

DOUBLE WOUND FUSIBLE ELEMENT AND ASSOCIATED FUSE

BACKGROUND OF THE INVENTION

1. Field of the Invention

Embodiments of the invention relate to the field of circuit protection devices. More particularly, the present invention relates to a fuse employing a double wound fusible wire element configured to withstand high surge current associated with inductive and capacitive loads.

2. Discussion of Related Art

Fuses are typically used as circuit protection devices and form an electrical connection with a component in a circuit to be protected. The fuse is designed to protect the circuit or circuit component by being the intentional weak link in the circuit. One type of fuse includes a housing consisting of a plastic base and a plastic cap with a pair of conductors or terminals which extend through the base and are connected via a fusible element that forms a bridge between the terminals inside the housing. In order to fix the terminals inside the base portion of the housing, a portion of each terminal and/or the base is deformed in order to pinch the base around the terminals, thereby clamping the base around the respective terminals. The fusible element is attached to ends of each of the two conductors projecting above the base. The fusible element is typically a conductive wire which is soldered to the ends of the two terminals. The fuse is placed in a circuit to be protected such that the fusible element melts when an abnormal overload condition occurs.

In certain circuit protection applications (e.g. motors, etc.), a surge current or short term current overload situation may typically occur until a steady state condition for the device is achieved. Fuses employed in these types of circuits must be designed to permit this short term surge to pass through the fuse without melting the fusible element. This high-surge condition is defined in terms of current and time ($I^2t$) where it is desirable to avoid an open circuit unless the current exceeds a specific percentage of the fuse's rated current.

One type of fuse used in these applications employs a spiral wound fuse element. In particular, the fuse element comprises a core of twisted yarn fibers with a fuse wire or wound around the core in a spiral pattern. The yarn that comprises the core is typically a ceramic material that is void of any material that could become conductive when the fuse is blown. The wound wire may include a plurality of wire strands configured to provide increased heat absorption indicative of, for example, a slow-blow or time-delayed fuse.

When a circuit overload is encountered, the passage of the excess current through the fuse element causes it to generate heat and thereby elevate the temperature of the fuse wire. In other words, the core acts as a heat sink to draw this heat away from the fuse wire, thereby lowering the temperature of the fuse wire. In this manner, the transfer of heat from the fuse wire to the core lengthens the time required before the fuse wire melting temperature is reached. For higher current-rated fuses, a larger diameter fuse wire is used to withstand higher current passing through the wire and therefore higher temperatures. However, the wound fuse wire is limited in size, thereby limiting the amount of excess current the wire can withstand as well as the amount of heat transfer between the wound wire and the core. Accordingly, there is a need for a fuse that utilizes a wound fusible wire element and a fuse employing the same configured to provide high I2t characteristics on the fuse element that will withstand high surge current associated with inductive and capacitive loads to protect particular types of circuit components and associated circuits.

SUMMARY OF THE INVENTION

Exemplary embodiments of the present invention are directed to an improved fusible element for use within a circuit protection device having a double wound fusible element configured to withstand high surge current associated with inductive and capacitive loads. In an exemplary embodiment, the fusible element includes an insulated core having a longitudinal axis; a first wire wound about the core along the longitudinal axis of the core, and a second wire wound substantially orthogonally about a longitudinal axis of the first wire such that the fusible element is configured to withstand a plurality of overcurrent pulses without melting.

In another exemplary embodiment, a fuse includes a housing defining a cavity therein, a first end cap attached to a first end of the housing, a second end cap attached to a second end of the housing and a fusible element disposed in the cavity. The fusible element has a first end electrically connected to the first end cap and a second end electrically connected to the second end cap. The fusible element comprises an insulated core having a longitudinal axis, a first wire wound about the core along the longitudinal axis of the core, and a second wire wound substantially orthogonally about a longitudinal axis of the first wire.

In another exemplary embodiment, a fuse includes a housing defining a cavity therein, a first end cap attached to a first end of the housing, a second end cap attached to a second end of the housing, and a fusible element disposed in the cavity. The fusible element has a first end electrically connected to the first end cap and a second end electrically connected to the second end cap. The fusible element comprises an insulated core having a longitudinal axis, a first wire wound about the core along the longitudinal axis of the core and a second wire wound substantially orthogonally about a longitudinal axis of the first wire.

DESCRIPTION OF EMBODIMENTS

Figure 1:
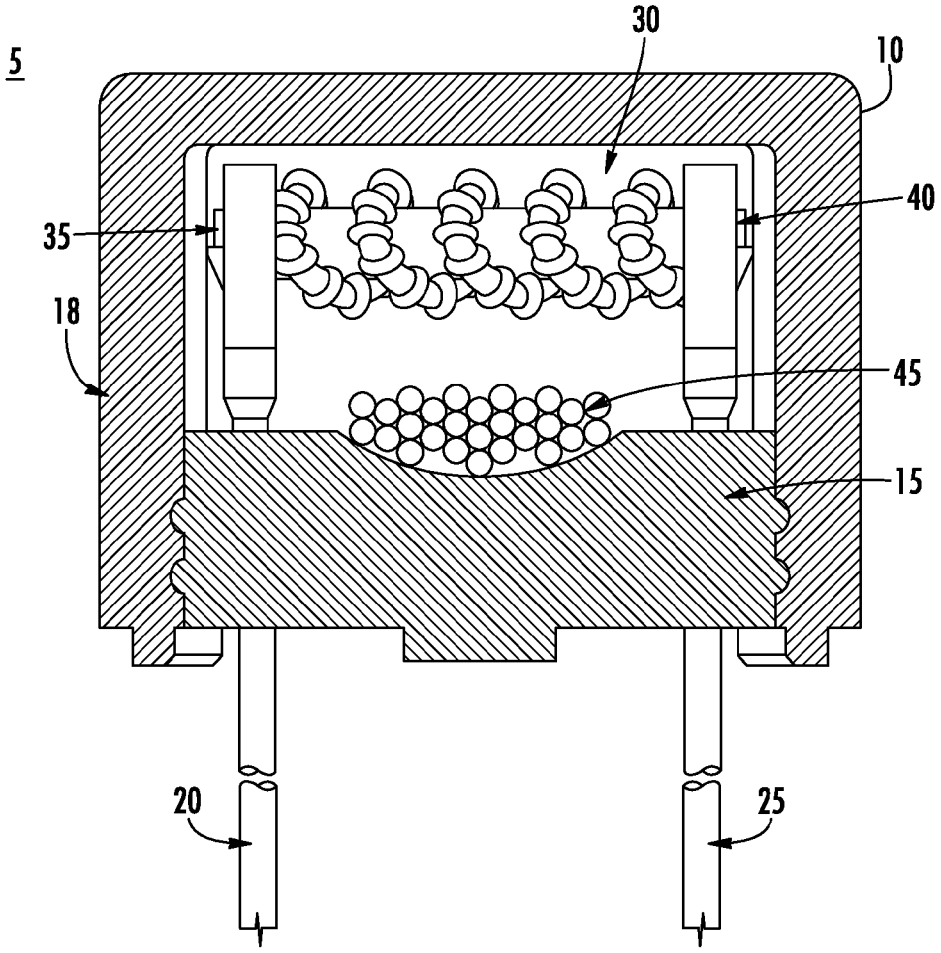
FIG. 1 illustrates an exemplary fuse in accordance with an embodiment of the present disclosure.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1 illustrates a fuse 5 comprising a housing 10 defined by a base 15 and a cap 18. The housing 10 forms a cavity within which a fusible element 30 is disposed. The housing may be formed of plastic or electrically insulating material capable of withstanding heat generated when the fuse is blown. The base and cap may also be made from plastic or other suitable material. A pair of conductors or terminals 20, 25 pass through the base 15 and are electrically connected via fusible element 30 disposed inside the housing 10. The upper ends of terminals 20 and 25 may include, for example, clips that retain ends of fusible element in contact with respective ends of the terminals. Solder portions 35 and 40 are used to connect ends of fusible element 30 to conductors 20 and 25 respectively. Fusible element 30 is shown as being configured in a parallel relationship to the longitudinal surface of base 15 and perpendicular to the longitudinal axis of each of the conductors 20 and 25. When an occurrence of a specified over-current or surge current condition occurs, the fusible element 30 melts or otherwise opens to interrupt the circuit path and isolate the protected electrical components or circuit from damage. In addition, an arc quenching material 45 may also be included within housing 10 to absorb the effects of the arc which occurs when the fusible element 30 melts after, for example, an over-current condition.

Figure 2A:
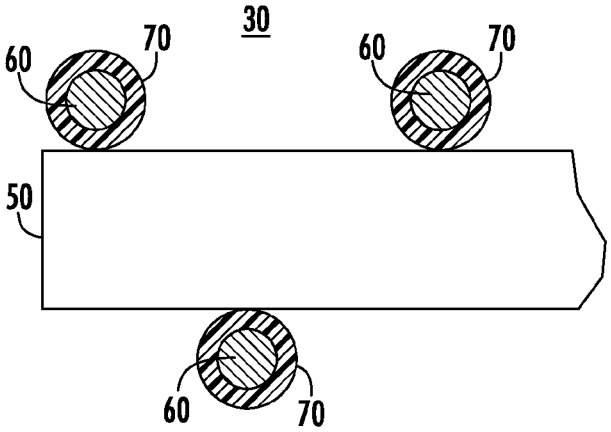
FIG. 2A is a cross-sectional view taken along the longitudinal axis of the fusible element of FIG. 2 in accordance with an embodiment of the present disclosure.
Figure 2:
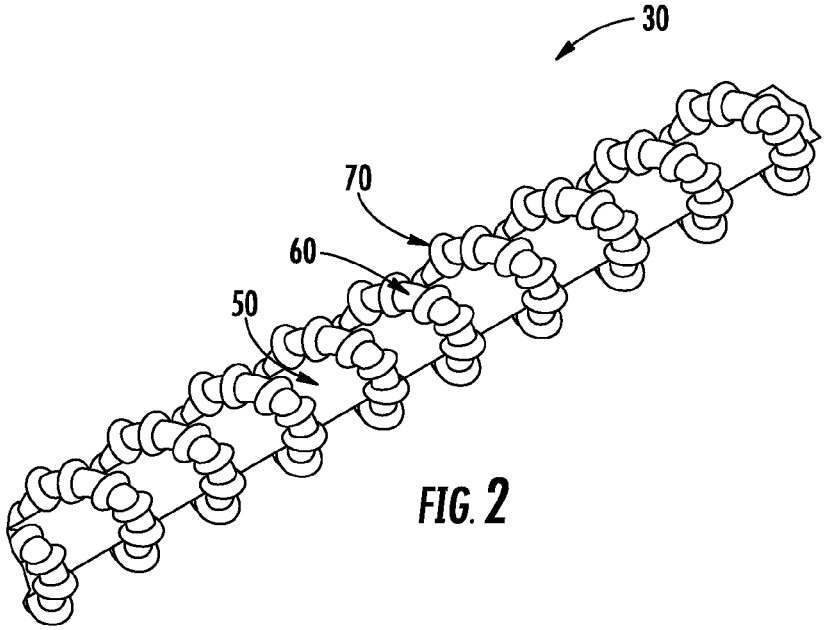
FIG. 2 is a perspective view of a fusible element in accordance with an embodiment of the present disclosure.

FIG. 2 is a perspective view of just fusible element 30 in accordance with an embodiment of the present disclosure. The fusible element 30 comprises a core 50 formed from an electrically insulating material such as, for example, glass yarn. A double wound wire is disposed around core 50. In particular, the double wound wire is defined by a first wire element 60 wound longitudinally about the core 50 from a first end to a second end and a second wire element 70 wound substantially orthogonally about a longitudinal axis of wire element 60. In other words, the wire element 60 has a longitudinal axis which corresponds to its position with respect to core 50 and second wire element 70 is disposed orthogonally to the longitudinal axis of wire element 60. The combination of wire elements 60 and 70 are wound about core 50 a plurality of turns or windings. The wire elements 60 and 70 used to form the double wound fusible element 30 comprise electrically conductive material configured to melt at a predetermined temperature (i.e. current rating) to interrupt the electrical circuit in the event of an overload. The wounded wire 70 on wire element 60 reduces the associated resistance without affecting the heat energy needed to melt the fuse element 30 when a current cut-off threshold is met.

FIG. 2A is a cross sectional view taken along the longitudinal axis of a portion of fusible element 30. Wire element 70 is wound about wire element 60 which is wound about core 50 to define the fusible element. Although this figure illustrates that wire element 70 is in contact with core 50, in one embodiment the portions of wire element 60 in between the windings of wire element 70 may be compressed on core 50 depending on the tension employed when winding the combination of wire element 60 and 70 about core 50.

Figure 3A:
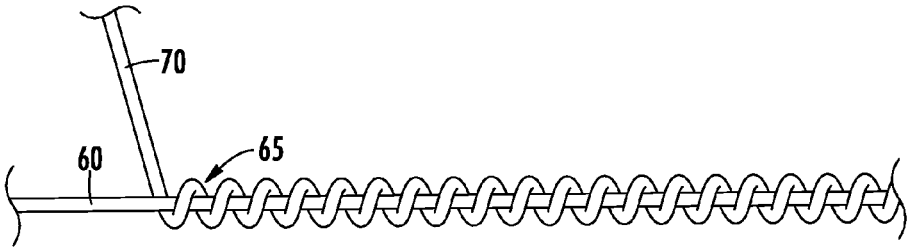
FIGS. 3A and 3B illustrate an exemplary process for forming a double wound fusible element in accordance with an embodiment of the present disclosure.
Figure 3B:
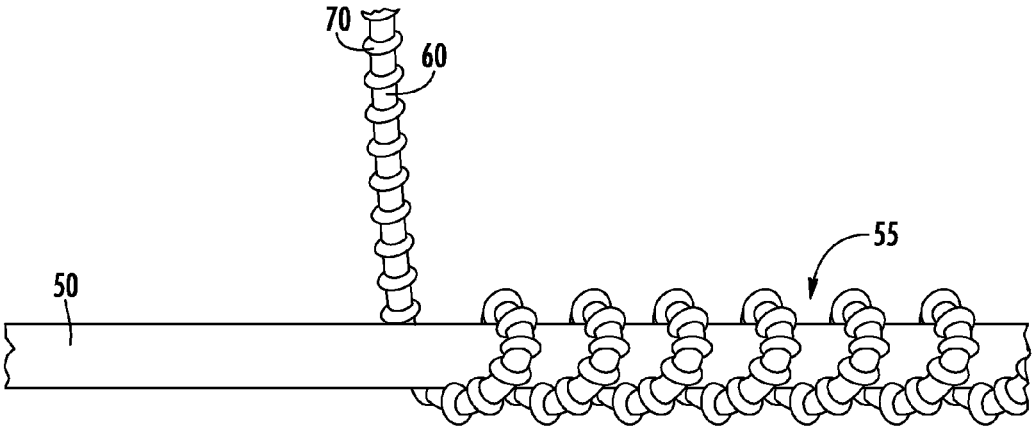

FIGS. 3A and 3B illustrate an exemplary process for forming the double wound fusible element 30. In particular, FIG. 3A illustrates the winding of wire element 70 about wire element 60 a plurality of windings. The winding of wire element 70 about wire element 60 forms a plurality of interstices 65 between the respective windings. The frequency of the windings of wire element 70 about wire element 60 and consequently the number of interstices 65 therebetween may vary depending on the desired rating of the fuse. FIG. 3B illustrates the winding of the combination of wire elements 60 and 70 about core 50. The winding of the combined wire elements 60 and 70 about core 50 form a plurality of interstices 55 between the respective windings. The contact of the wire elements 60 and 70 about the core 50 provides heat transfer from the wire to the core. In addition, by utilizing this double wound configuration, the mass of the fusible element 30 is increased which significantly increases the $I^2t$ value.

As noted briefly above, the $I^2t$ value is the measurement of energy required to blow the fuse element 30 which corresponds to the measurement of the damaging effect of an overcurrent condition on the protected device or circuit. In particular, $I^2t$ is a calculation of how many overcurrent pulses the fuse can withstand. This is done with the comparison of $I^2t$ of the pulse and the fuse which is referred to as "relative" $I^2t$. By employing a double wound fusible wire (60, 70) configuration about core 50, the mass of the fusible element 30 is increased. With this increased mass, the amount of heat that the fusible element 30 generates due to an overcurrent condition is increased. Based on testing, it is believed that the $I^2t$ value using the double wound configuration in accordance with the present disclosure is increased approximately 250%-300% as compared with a single wound configuration (i.e. only employing wire element 60).

Figure 4:
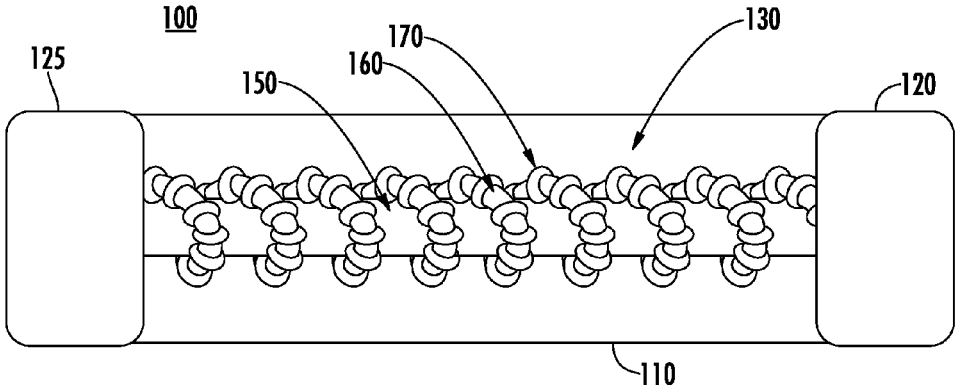
FIG. 4 illustrates an exemplary fuse utilizing the fusible element in accordance with an embodiment of the present disclosure.

FIG. 4 is a perspective view (not drawn to scale) of an alternative fuse 100 employing the double wound fusible element shown with reference to FIG. 2. In particular, fuse 100 includes a housing 110 which may be referred to as a tube or cartridge. Housing 110 may be made from a ceramic or similar material. Each of a pair of electrically conductive end caps 120, 125 is positioned at the respective ends of housing 110 to contain fusible element 30 therein. In addition, the respective ends of fusible element 130 are electrically connected to end caps 120 and 125 usually by soldering. As noted above, fusible element 30 comprises wire element 170 wound orthogonally about a longitudinal axis of wire element 160 and the combination of wire elements 160 and 170 are wound about core 150 a plurality of turns or windings. The wire elements 160 and 170 used to form the double wound fusible element 130 comprise electrically conductive material configured to melt at a predetermined temperature to interrupt the electrical circuit in the event of a prolonged overload condition.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

What is claims is:

1. A fuse comprising:

a housing comprising a base and a cap, said base disposed within said cap to define a cavity within said housing;

a first and second terminals extending through corresponding openings in said base and into said cavity;

a fusible element having a first end electrically connected to said first terminal and a second end electrically connected to said second terminal within said cavity, said fusible element comprising:

an insulated core having a longitudinal axis;

a first wire wound about said core along the longitudinal axis of said insulated core; and a second wire wound about said first wire substantially orthogonal to the longitudinal axis of the first wire; and an arc quenching material disposed within a depression in a continuous section of said base.

2. The fuse of claim 1 wherein said core comprises glass yarn.

3. The fuse of claim 1 wherein said first wire wound about said core defines a plurality of windings and a corresponding plurality of interstices defined therebetween.

4. The fuse of claim 1 wherein said second wire wound about said first wire defines a plurality of windings and a corresponding plurality of interstices defined therebetween.

5. The fuse of claim 1, wherein said base comprises a plurality of protrusions disposed on an exterior surface and said cap comprises a plurality of indentations disposed on said inside walls, said protrusions and said indentations positioned such that said protrusions fit within corresponding ones of said indentations when said base is disposed within said cap.

6. The fuse of claim 1, wherein said base and said cap are formed from an electrically insulating material and wherein portions of said first and second terminals extending into said cavity are disposed adjacent to an inside wall of said cap and said fusible element is disposed adjacent to an upper inside surface of said cap.

7. The fuse of claim 1, wherein the more frequent the windings of the second wire about the first wire, the more energy required to blow the fuse element.

* * * * *